US009804628B2

(12) United States Patent
Hashitani et al.

(10) Patent No.: US 9,804,628 B2
(45) Date of Patent: Oct. 31, 2017

(54) REFERENCE VOLTAGE GENERATOR

(71) Applicant: SEIKO INSTRUMENTS INC., Chiba-shi, Chiba (JP)

(72) Inventors: Masayuki Hashitani, Chiba (JP); Yoshitsugu Hirose, Chiba (JP)

(73) Assignee: SII Semiconductor Corporation (JP)

( * ) Notice: Subject to any disclaimer, the term of this patent is extended or adjusted under 35 U.S.C. 154(b) by 133 days.

(21) Appl. No.: 14/521,669

(22) Filed: Oct. 23, 2014

(65) Prior Publication Data

US 2015/0115912 A1 Apr. 30, 2015

(30) Foreign Application Priority Data

Oct. 25, 2013 (JP) ..... 2013-222586

(51) Int. Cl.
*G05F 3/16* (2006.01)
*G05F 3/24* (2006.01)

(52) U.S. Cl.
CPC ..... *G05F 3/242* (2013.01)

(58) Field of Classification Search
CPC ... G05F 3/00; G05F 3/02; G05F 3/242; G05F 3/30; G05F 3/245; G05F 3/247; G05F 3/225; G05F 3/227; H02M 3/158
USPC ..... 323/311, 312, 313
See application file for complete search history.

(56) References Cited

U.S. PATENT DOCUMENTS 3,781,648 A * 12/1973 Owens ..... G05F 1/567 323/313
4,008,406 A * 2/1977 Kawagoe ..... H01L 27/0605 257/E27.012
4,205,263 A * 5/1980 Kawagai ..... H01L 27/0727 257/E27.033
5,253,201 A * 10/1993 Atsumi ..... G11C 16/30 365/185.2
6,087,821 A * 7/2000 Kojima ..... G05F 3/262 323/315
2003/0197552 A1* 10/2003 Watanabe ..... G05F 3/245 327/541
2011/0102071 A1* 5/2011 Zarbadi ..... H02M 3/073 327/539

OTHER PUBLICATIONS

Patent Abstracts of Japan, Publication No. 56-108258, Publication Date Aug. 27, 1981.

* cited by examiner

*Primary Examiner* — Alex Torres-Rivera
(74) *Attorney, Agent, or Firm* — Adams & Wilks

(57) ABSTRACT

A reference voltage generator includes a depletion NMOS transistor of a first conductivity type for causing a constant current to flow, and an enhancement NMOS transistor of the first conductivity type diode-connected to the depletion NMOS transistor to generate a reference voltage. A resistor surrounds the periphery of the depletion NMOS transistor and the periphery of the enhancement NMOS transistor. A diode is connected in series to a constant current source and provides a voltage that controls current flowing through the resistor when the environment temperature is lower than a preset temperature. The reference voltage generator can operate under a given preset temperature environment because a voltage consumed in the resistor becomes approximately constant in accordance with the voltage provided from the diode.

1 Claim, 3 Drawing Sheets

REFERENCE VOLTAGE GENERATOR

BACKGROUND OF THE INVENTION

1. Field of the Invention

The present invention relates to a reference voltage generator for generating a reference voltage within a semiconductor integrated circuit.

2. Description of the Related Art

In recent years, the improvement of the precision of an electronic apparatus has progressed, and the increased precision of an IC for controlling the electronic apparatus has been required. As a result, in the IC, especially, a power management IC represented by a voltage detector or a voltage regulator, along with the miniaturization and the versatility of a portable apparatus to be loaded with the IC, it is required that even when a temperature is changed in the inside of the IC due to a change in ambient temperature environment, a reference voltage generator can generate a reference voltage with high precision, that is, temperature characteristics of the reference voltage become flatter.

A circuit used in a reference voltage generator in the related art is described with reference to FIG. 4. FIG. 4 is a circuit diagram of the reference voltage generator in the related art as shown in Japanese Published Patent Application JP 56-108258. A depletion NMOS transistor (hereinafter referred to as a D type NMOS transistor) 1 which is connected so as to function as a current source causes a constant current to flow into a diode-connected enhancement NMOS transistor (hereinafter referred to as an E type NMOS transistor) 2. By causing this constant current to flow into the E type NMOS transistor 2, a reference voltage corresponding to threshold voltages and sizes of the respective transistors is generated in the E type NMOS transistor 2.

SUMMARY OF THE INVENTION

The present invention has been made in view of the demand described above, and it is therefore an object of the present invention to provide a reference voltage generator having flatter temperature characteristics.

In order to solve the problem described above, in a reference voltage generator according to one embodiment of the present invention, the periphery of a depletion NMOS transistor and an enhancement NMOS transistor which construct a reference voltage generator is surrounded by a resistor. In addition, the reference voltage generator has a circuit configuration including a diode which can detect temperature and a constant current source. The constant current source is trimmed with high precision for a preset temperature. In this way, a constant diode output signal can be obtained under a given temperature environment. In addition, a voltage with which the constant diode output signal is applied to the resistor is adjusted. In this way, the reference voltage generator operates under a constant temperature environment, and hence shows flatter temperature characteristics.

As set forth hereinabove, according to one embodiment of the present invention, the reference voltage generator operates under the given temperature environment, and hence the reference voltage which has been difficult to flatten due to the change in temperature can be flattened.

DETAILED DESCRIPTION OF THE EMBODIMENT

An embodiment of the present invention is now described with reference to the attached drawings. Firstly, a reference voltage generator according to an embodiment of the present invention is described below with reference to a schematic top plan view of FIG. 1A and a schematic circuit diagram of FIG. 1B.

Figure 4:
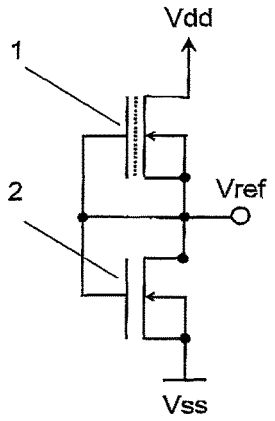
FIG. 4 Prior Art
FIG. 4 is a schematic circuit diagram illustrating the reference voltage generator in the related art.

The reference voltage generator includes a depletion NMOS transistor (hereinafter referred to as a D type NMOS transistor) 1 and an enhancement NMOS transistor (hereinafter referred to as an E type NMOS transistor) 2. The arrangement of the D type NMOS transistor 1 and the E type NMOS transistor 2 is identical to that in the case of the reference voltage generator shown in FIG. 4 in the related art in terms of a circuit configuration.

Figure 1A:
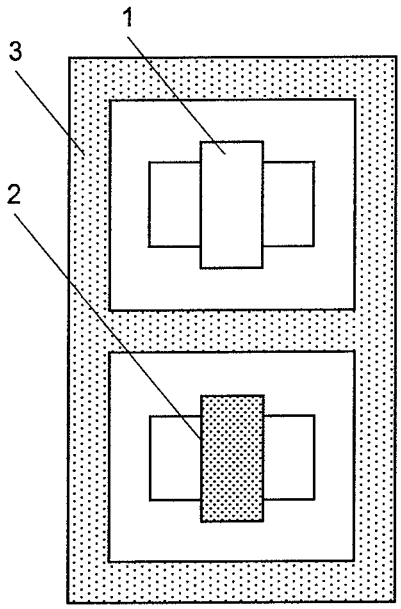
FIG. 1A is a schematic top plan view illustrating features of a reference voltage generator according to an embodiment of the present invention.

The reference voltage generator according to the embodiment of the present invention, as illustrated in FIG. 1A, includes a resistor 3 so as to surround the periphery of the D type NMOS transistor land the E type NMOS transistor 2. The resistor 3, for example, can be formed of a polycrystalline silicon film. A resistance value of the resistor 3 can be freely set by selecting a size, a thickness, and a concentration of impurities to be diffused of the polycrystalline silicon film.

Figure 1B:
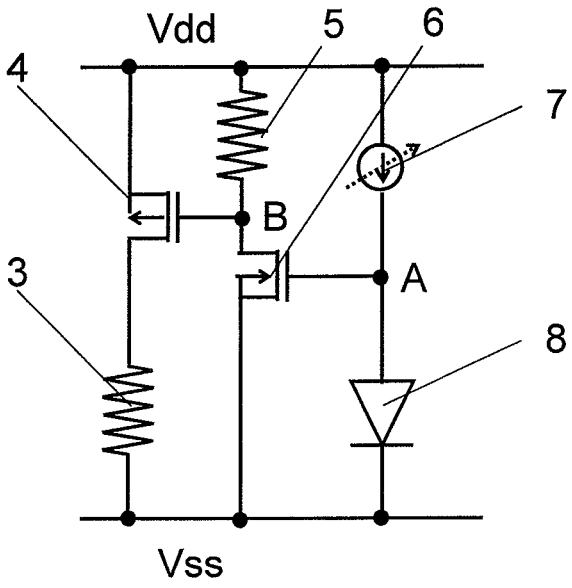
FIG. 1B is a schematic circuit diagram illustrating the features of the reference voltage generator according to the embodiment of the present invention.

The reference voltage generator according to the embodiment of the present invention, as illustrated in FIG. 1B, further includes a PMOS transistor 4 which is connected in series to the resistor 3 described above, an NMOS transistor 6 which is connected in parallel to the PMOS transistor 4 and in series to another resistor 5, and a diode 8 which is connected in parallel to the NMOS transistor 6 and in series to a constant current source 7 which can be trimmed with high precision. The constant current source 7 of each of the individual ICs can be trimmed for a preset temperature, and hence a bit which is subordinate to a trimming fuse has resolution enough to enable a value of the constant current to be sufficiently set with high precision. The preset temperature, for example, is 40° C.

In the reference voltage generator according to the embodiment of the present invention, the constant current source 7 is trimmed with high precision for the preset temperature described above, and hence a constant voltage can be applied to a point A of FIG. 1B on the anode side of the diode 8 under a preset temperature environment. An output voltage from the diode 8 is applied as a gate voltage of the NMOS transistor 6 having a threshold voltage larger than the output voltage. When the environment temperature is lower than the preset temperature, in order to compensate for reduction of a current caused to flow through the diode 8, the voltage developed at the point A is increased, and the NMOS transistor 6 is turned ON to become a conduction state. As a result, a current is caused to flow through the resistor 5. Because the voltage is mainly applied across the resistor 5, a voltage developed at a point B of FIG. 1B approaches a lower power source voltage Vss. In addition, when the voltage developed at the point B of FIG. 1B is reduced to fall below the threshold value of the PMOS transistor 4, the PMOS transistor 4 is also turned ON to become a conduction state. Therefore, the current is caused to flow through the resistor 3 to generate the heat therefrom. If the above-mentioned state of the reference voltage generator is referred to as an ON state, then, when the environment temperature is higher than the preset temperature, both the NMOS transistor 6 and the PMOS transistor 4 become an OFF state by the reverse operation. As a result, no current is caused to flow through the resistor 3 in the circuit of the reference voltage generator.

Figure 2:
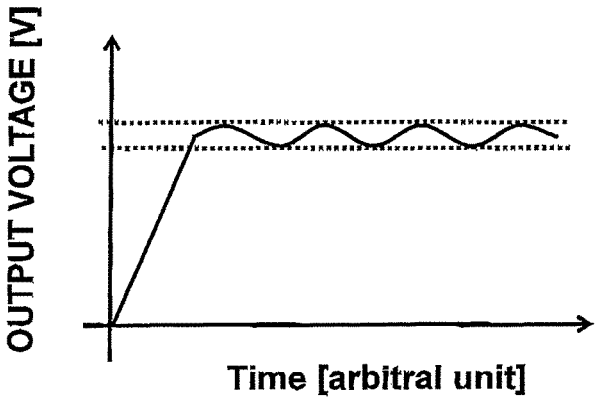
FIG. 2 is a schematic characteristic graph showing the features of the reference voltage generator according to the embodiment of the present invention.
Figure 3:
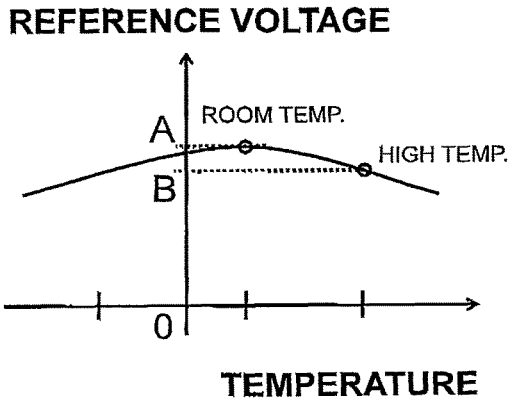
FIG. 3 Prior Art
FIG. 3 is a schematic characteristic graph showing a reference voltage generator in the related art.

The ambient temperature of the D type NMOS transistor 1 and the E type NMOS transistor 2, which serve to generate the reference voltage, is controlled by the heat generating circuit for generating the heat in the resistor 3 described above when the ambient temperature is lower than the preset temperature. In this way, after a lapse of given time, the change in temperature can be kept approximately in the predetermined range. Hence, as shown in FIG. 2, the reference voltage generator according to the embodiment of the present invention is capable of obtaining an approximately constant output voltage even when the time has lapsed.

What is claimed is:

1. A reference voltage generator, comprising:

a depletion NMOS transistor configured to cause a constant current to flow;

an enhancement NMOS transistor diode-connected to the depletion NMOS transistor to generate a reference voltage;

a resistor surrounding a periphery of both the depletion NMOS transistor and the enhancement NMOS transistor, a constant current source; and a diode connected in series to the constant current source, wherein the diode provides a voltage that controls a current flowing through the resistor when an environmental temperature is lower than a preset temperature.

* * * * *